US009682396B2

(12) United States Patent
Eckman et al.

(10) Patent No.: US 9,682,396 B2
(45) Date of Patent: Jun. 20, 2017

(54) DUAL FLOW CELL FLUID DELIVERY SYSTEMS

(71) Applicant: Wasatch Microfluidics, Inc., Salt Lake City, UT (US)

(72) Inventors: Joshua W. Eckman, Salt Lake City, UT (US); Adam Miles, Salt Lake City, UT (US); James Smith, Bountiful, UT (US); Christopher Morrow, Salt Lake City, UT (US); Bruce K. Gale, Salt Lake City, UT (US)

(73) Assignee: CARTERRA, INC., Salt Lake City, UT (US)

( * ) Notice: Subject to any disclaimer, the term of this patent is extended or adjusted under 35 U.S.C. 154(b) by 76 days.

(21) Appl. No.: 14/667,351

(22) Filed: Mar. 24, 2015

(65) Prior Publication Data

US 2015/0266021 A1 Sep. 24, 2015

Related U.S. Application Data

(60) Provisional application No. 61/969,489, filed on Mar. 24, 2014.

(51) Int. Cl.

| | |
|---|---|
| ***B05C 5/02*** | (2006.01) |
| ***B05C 11/10*** | (2006.01) |
| ***B01L 3/02*** | (2006.01) |

(52) U.S. Cl.

CPC ..... *B05C 11/1034* (2013.01); *B01L 3/0262* (2013.01); *B05C 5/027* (2013.01); *B05C 5/0287* (2013.01); *B05C 11/1005* (2013.01); *B05C 11/1015* (2013.01); *B01L 2200/0689* (2013.01); *B01L 2200/141* (2013.01); *B01L 2200/143* (2013.01); *B01L 2300/023* (2013.01); *B01L 2300/0636* (2013.01); *B01L 2300/0822* (2013.01); *B01L 2400/049* (2013.01); *B01L 2400/0487* (2013.01)

(58) Field of Classification Search

CPC ..... B05C 11/1034; B05C 11/1005; B05C 5/0287; B05C 5/027; B05C 11/1015; B01L 3/0262; B01L 2400/049; B01L 2200/143; B01L 2300/023; B01L 2200/141; B01L 2300/0822; B01L 2400/0487; B01L 2200/0689

See application file for complete search history.

(56) References Cited

U.S. PATENT DOCUMENTS

| | | | |
|---|---|---|---|
| 5,641,640 | A | 6/1997 | Hanning |
| 5,965,456 | A | 10/1999 | Malmqvist et al. |
| 6,008,893 | A | 12/1999 | Roos et al. |
| 6,207,381 | B1 | 3/2001 | Larsson et al. |

(Continued)

*Primary Examiner* — Paul Hyun

(74) *Attorney, Agent, or Firm* — Thorpe North & Western LLP

(57) ABSTRACT

A system for depositing substances onto a deposition surface can comprise a first contact spotter comprising multiple spotting orifices fed by multiple fluid inlet conduits such that the first contact spotter is capable of depositing multiple spots of different substances onto the deposition surface simultaneously, and a second contact spotter comprising a second spotting orifice fed by a second fluid inlet conduit. The system can also include a positioning device adapted to alternatively position and seal the first contact spotter and second contact spotter on the deposition surface at an overlapping location.

41 Claims, 4 Drawing Sheets

(56) References Cited

U.S. PATENT DOCUMENTS

| | | | | |
|---|---|---|---|---|
| 6,493,097 | B1 | 12/2002 | Ivarsson | |
| 6,589,798 | B1 | 7/2003 | Lofas | |
| 6,714,303 | B2 | 3/2004 | Ivarsson | |
| 6,999,175 | B2 | 2/2006 | Ivarsson | |
| 7,015,043 | B2 | 3/2006 | Roos et al. | |
| 7,081,958 | B2 | 7/2006 | Ivarsson | |
| 7,219,528 | B2 | 5/2007 | Tidare et al. | |
| 7,262,866 | B2 | 8/2007 | Ivarsson | |
| 7,320,879 | B2 | 1/2008 | Karlsson et al. | |
| 7,373,255 | B2 | 5/2008 | Karlsson et al. | |
| 8,210,119 | B2 | 7/2012 | Gale et al. | |
| 8,211,382 | B2 | 7/2012 | Myszka et al. | |
| 8,383,059 | B2 | 2/2013 | Chang-Yen et al. | |
| 8,999,726 | B2 | 4/2015 | Chang-Yen et al. | |
| 2001/0009136 | A1* | 7/2001 | Bryning | B01J 19/0046 118/256 |
| 2005/0005948 | A1* | 1/2005 | Kurunczi | A61L 2/14 134/1 |
| 2005/0136534 | A1* | 6/2005 | Austin | G01N 35/1011 435/287.2 |
| 2010/0248994 | A1 | 9/2010 | Gale et al. | |
| 2014/0171342 | A1 | 6/2014 | Gale et al. | |
| 2015/0269312 | A1 | 9/2015 | Miles et al. | |

* cited by examiner

DUAL FLOW CELL FLUID DELIVERY SYSTEMS

The present application claims the benefit of U.S. Provisional Patent Application No. 61/969,489, filed on Mar. 24, 2014, the entirety of which is incorporated herein by reference.

BACKGROUND

Sensing and imaging systems are used by researchers in the academic, pharmaceutical, and biotechnology sectors to characterize biomolecular interactions. These platforms are used in a number of areas, such as antibody characterization, proteomics, vaccines, immunogenicity, and biopharmaceutical development and production. Numerous commercial biosensor instruments exist on the market, such as label-free biosensors and fluorescent microarray scanners. Commercially available label-free biosensor instruments are typically limited by the low throughput of the two-dimensional fluid delivery systems. Currently, some label-free biosensors employ microfluidic systems to deliver the sample to the sensing or imaging surface. The use of 2D flow delivery limits the number of samples that can be delivered simultaneously to the sensor surface. Most commercial label free biosensors employ 1 to 8 channels, each of which can monitor a binding interaction in a one-to-one approach, i.e. one biomolecule in solution (the analyte) being exposed to one biomolecule on the sensor surface (the ligand). This format does allow for a one-to-many approach if biomolecules are run sequentially, but sample consumption and assay time will increase accordingly.

Another common approach used by biosensor platforms is the printing of biomolecules in a microarray format prior to loading into the biosensor or imaging system. Common printing approaches include pin printing, piezo printing, and microfluidic array printing. After printing, the chip is loaded into the biosensor and a 2D flow cell is applied to inject analyte over the microarray of samples, in a one-to-many approach. This enables multiplexing of a single analyte injection against a panel of surface-immobilized ligands, conserving sample and decreasing assay time. However, these instruments are not well suited for assays where the biomolecule cannot be easily tethered to the surface without compromising its binding profile, such as small molecule drug compounds. Further, screening large panels of ligands may require separate printing and loading of sensor chips, which often will require a manual intervention and chip stabilization. Microarray experiments also expose the sensing/imaging surface and biomolecules to air during the printing process. Many of the analytes and targets used in microarray experiments are sensitive and can be damaged by being exposed to air or other buffers that are dissimilar to the fluid environment of biological systems.

BRIEF DESCRIPTION OF THE DRAWINGS

Reference will now be made to the exemplary embodiments illustrated, and specific language will be used herein to describe the same. It will nevertheless be understood that no limitation of the scope of the invention is thereby intended by virtue of a provided example.

DETAILED DESCRIPTION

Figure 1:
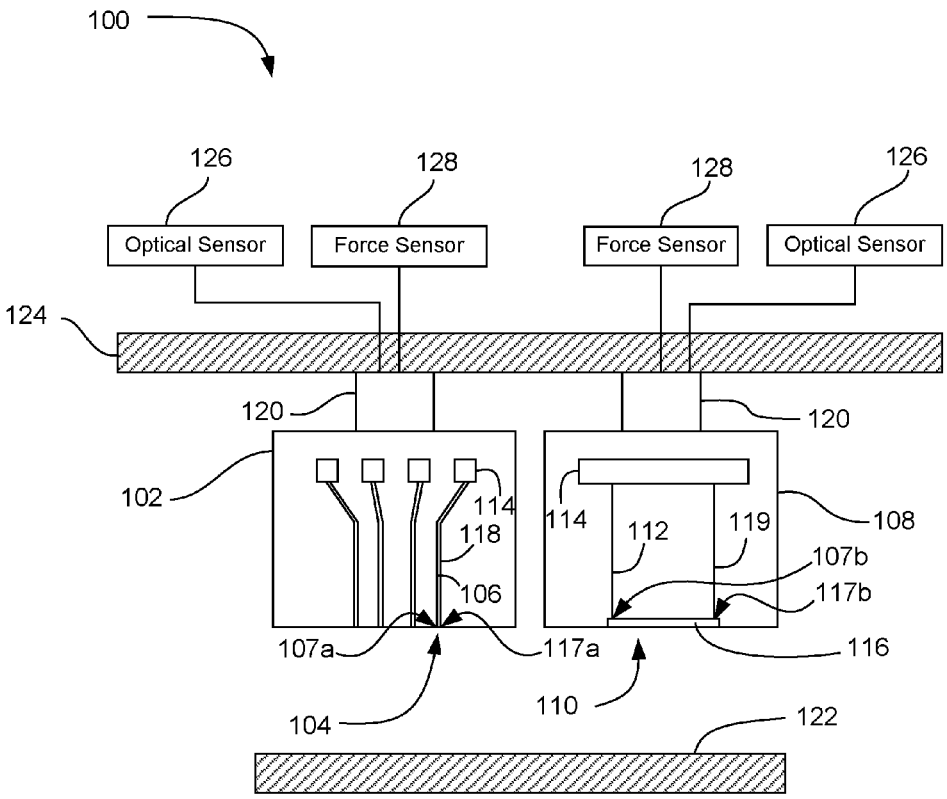
FIG. 1 is an illustration of aspects of a dual contact spotter system in accordance with an embodiment of the present disclosure.

Before the present invention is disclosed and described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

In describing and claiming the present invention, the following terminology will be used in accordance with the definitions set forth below.

It is noted that, as used in this specification and the appended claims, the singular forms "a," "an," and "the" include plural referents unless the context clearly dictates otherwise. Thus, for example, reference to "an orifice" includes one or more of such orifices, and reference to "the deposition surface" includes reference to one or more deposition surfaces.

As used herein, the term "fluid" refers to any material that has the ability to flow, which can also be described as the ability to take the shape of its container, or does not substantially resist deformation. This term includes liquids or gases. Also, a dispersion is considered a fluid herein, even though there are solids dispersed in a liquid. This term also includes non-Newtonian fluids, i.e. fluids with viscosities that change with an applied strain rate, and Newtonian fluids, i.e. fluids with viscosities that are nearly constant regardless of applied forces.

As used herein, the term "substantially" or "substantial" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall result as if absolute and total completion were obtained. The use of "substantially" is equally applicable when used in a negative connotation to refer to the complete or near complete lack of action, characteristic, property, state, structure, item, or result. For example, a composition that is "substantially free of" particles would either completely lack particles, or so nearly completely lack particles that the effect would be the same or similar as if it completely lacked particles. In other words, a composition that is "substantially free of" an ingredient or element may still contain such an item as long as there is no significant or measurable effect thereof.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 micron to about 5 microns" should be interpreted to include not only the explicitly recited values of about 1 micron to about 5 microns, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Current biosensor and imaging platforms are usually configured to perform either low throughput screening in a one-on-one format within a closed fluidic system, or multiplexing via one-on-many array based systems. These platforms limit researchers to a limited sample throughput and restrict the type of experiment to either screening or multiplexing. The standard fluidic delivery system in biosensors and imaging platforms is the 2D flow cell. One advantage of this fluidic system is a reduction in sample consumption while using flow cells across an array surface, if there is a binding step in which a single analyte will be bound to a number of ligand spots (such as in hybridoma screening, where many antibodies can be immobilized on the surface and then all spots exposed to antigen injections of increasing concentration). Further, the fluidic systems are designed to optimize fluidic delivery to address mass transport concerns. This fluidic delivery system can be a powerful tool for measuring kinetics, affinity, competitive binding experiments, peptide mapping or antibody epitope binning. These advantages have resulted in 2D flow cells being used in the majority of existing sensor and imaging system designs.

The 3D microchannel network is another type of fluid delivery system. Such platforms can operate by printing biomolecule arrays using a 3D microchannel network, such that a multitude of ligand spots can be printed in parallel within a closed fluidic system once the printing chambers are sealed onto a flat surface. This 3D delivery system can be used to inject samples over a biosensor for real-time analysis, enabling a many-on-one or many-on-many approach wherein a number of analytes can be simultaneously injected over a surface coated with one or more ligands. When coupled with laboratory automation for changing the analyte source plates, such in accordance with the systems and methods described herein, this configuration can be used for the screening of thousands of samples in a single run. Combining multi-channel microfluidic systems with sensors can increase the analyte sample throughput for screening applications, such that multiple analytes can be screened simultaneously against a ligand analyte.

Thus, in accordance with the present disclosure, significant improvements can be realized over current platforms if researchers are able to perform both screening and multiplexing experiments on the same instrument. By combining the 3D microchannel network with a 2D flow cell and enabling the automated robotic switching between the two delivery systems, researchers can conduct screening and multiplexing in one system with the flexibility to conduct one-on-many, many-on-one, or many-on-many experiments in a high-throughput, automated manner while not exposing the biomolecules to unfavorable milieus.

In one example, a system for depositing substances onto a deposition surface can comprise a first contact spotter comprising multiple spotting orifices fed by multiple fluid inlet conduits such that the first contact spotter is capable of depositing multiple spots of different substances onto the deposition surface simultaneously, and a second contact spotter comprising a second spotting orifice fed by a second fluid inlet conduit. They system can also include a positioning device adapted to alternatively position and seal the first contact spotter and second contact spotter on the deposition surface at an overlapping location.

In a more detailed example, a system with dual flow cells which can be robotically actuated can perform both screening (using a many-on-one mode with a 3D highly parallel flow cell network) and multiplexing (using a one-on-many mode with 2D flow cell). A system with dual flow cells can also be used to perform "many-on-many" experiments, in which many different analytes are tested against many different targets. This can create an efficient workflow for assay development and optimization experiments. The system can be automated to switch between the flow cells to decrease labor time for researchers. The flexibility of using either a 3D highly parallel flow cell network and/or 2D flow cell can allow researchers the flexibility to conduct one-on-many, many-on-one, or many-on-many experiments in a high-throughput, automated manner.

In some cases, the system can be used to print microarrays submerged under a liquid. One reason that current biosensor technologies must generally choose between screening or multiplexing is that changing the contact spotter during the experiment can expose sensitive proteins to the air, possibly damaging the proteins. The dual spotter system of the present disclosure eliminates the need to change to a different contact spotter and allows for the microarrays to be submerged under a liquid, protecting fragile biomolecules or cells. Though these systems can be used when submerged, this is only one example of the benefits of the present technology.

While this disclosure delineates several embodiments, modifications including but not limited to flow cell design, sensor/imaging system, and flow cell positioning devices can be made herein without departing from the scope of the disclosure. For example, in one embodiment of the present disclosure, a Surface Plasmon Resonance (SPR) imager for protein characterization can be utilized as biosensor. In a potential variation, rather than using an SPR, a microscope or other biosensor can be used. In addition, cells, proteins, or other biomolecules such as DNA can be used in various embodiments as will be understood by persons skilled in this art. Therefore, the scope of the present disclosure should be determined by the appended claims, and not limited by any specific embodiments described herein.

With the above description in mind, FIG. 1 illustrates a dual contact spotter system 100 in accordance with an embodiment of the present disclosure. The system can include a first contact spotter 102 with a first spotting orifice

104 fed by a first fluid inlet conduit 106, and a second contact spotter 108 with a second spotting orifice 110 fed by a second fluid inlet conduit 112. In the particular embodiment shown, the contact spotters can be a continuous flow microspotter in which fluid flows from a fluid reservoir 114 through a fluid inlet conduit 106, 112 via a respective first opening 107*a*, 107*b* into a flow chamber 116 across the spotting orifice 104, 110 and then out through a respective second opening 117*a*, 117*b* into a fluid return conduit 119. It is noted that the terms "first" and "second" are used herein and throughout the present disclosure. These terms are meant to be relative to one another only in the context in which they are mentioned, and further, do infer any order of use that any one of these terms should be associated exclusively with a specific spotter. For example, contact spotter 102 could be referred to as the "second contact spotter" and contact spotter 108 could be referred to as the "first contact spotter" with no consequence.

Returning now to FIG. 1, a positioning device 120 can be adapted to alternatively position and seal the first contact spotter 102 and second contact spotter 108 on a deposition surface 122. In the particular embodiment shown, the positioning system comprises an actuator for each contact spotter, configured to move along a linear track 124. The actuators can position the contact spotters over the deposition surface and then lower them to seal the spotting orifices 104, 110 against the deposition surface. Optical sensors 126 can help the actuators position the contact spotters, and force sensors 128 can help the actuators seal the contact spotters against the deposition surface.

Generally, a system for depositing substances onto a deposition surface in accordance with the present disclosure can include at least one contact spotter with multiple spotting orifices. This first contact spotter having multiple spotting orifices can include multiple fluid inlet conduits to feed a fluid to the multiple spotting orifices. This can allow the contact spotter to deposit multiple spots of different substances onto the deposition surface simultaneously. The system can also include a second contact spotter. In some cases the second contact spotter can have a single spotting orifice fed by a second fluid inlet conduit. In other cases the second contact spotter can have multiple spotting orifices, similar to the first contact spotter. The system can further include a positioning device adapted to alternatively position and seal the first contact spotter and second contact spotter on the deposition surface (in either order).

The contact spotters can have spotting orifices that are capable of interfacing with the deposition surface to create a fluid-tight seal. This allows each spot to be contained and avoids cross-contamination of different substances deposited in different spots. Typically, the contact spotter can be sealed onto the deposition surface and then a fluid can be fed through the fluid inlet conduit to contact the deposition surface. The fluid can include a substance to be spotted onto the surface.

In some embodiments, the contact spotters can be continuous flow microspotters. Each continuous flow microspotter can include an outlet cavity defined at least in part by a spotting orifice, a first opening, and a second opening. A first conduit can be fluidly coupled to the first opening, and a second conduit can be fluidly coupled to the second opening. The continuous flow microspotter can also be adapted so that fluid flowing through the first conduit and the second conduit is communicated among the first opening, the second opening, and a deposition surface when the spotting orifice is sealed against the deposition surface to form a deposition spot on the deposition surface. For a continuous flow microspotter with multiple spotting orifices, each spotting orifice can have a corresponding outlet cavity, first opening, second opening, first conduit, and second conduit.

Conduits may also be referred to as channels, microchannels, microfluidic channels, canals, microcanals, microtubules, tubules and/or tubes, where the terms are used to describe a fluid pathway. The terms "inlet conduit," "inlet microchannel," or "inlet microtubule" may be either the first or second conduit, and the terms "outlet conduit," "outlet microchannel," or "outlet microtubule" may be the alternative conduit of the pathway. In some embodiments, which conduit is the inlet conduit varies as a substance flows back and forth between the conduits. For the purpose of describing the invention, "inlet" or "outlet" may be used to reference the proximal end of the respective conduit with respect to the location of the deposition chamber/printing orifice.

The conduits can be micro-scaled, such as microchannels and/or microtubules. These conduits are used to guide the substance(s) to and from the area of spot deposition on the deposition surface, wherein the flow through the microchannel or microtubules produces a high surface concentration in a specific region. Each deposition region can be individually addressed with its own microfluidic channel, which microfluidic channels may be assembled such that a large-number of deposition regions may be addressed in parallel. A spotting orifice in the microfluidic channel is adapted to form a seal with the deposition surface, such that a fluid in the microfluidic channel contacts the surface, allowing deposition of substances in the fluid on the surface. The fluid can be injected into an inlet of a first conduit, flowed to the deposition spot area via a first microfluidic channel to the orifice, and then flowed out through a second conduit.

In one embodiment, the first and second conduits can be connected to a single fluid reservoir, thereby allowing recycling of the fluid and any substances contained therein.

In another embodiment, the first conduit of a microfluidic channel is connected a first reservoir and the second conduit of the microfluidic channels connected to a second reservoir. A plurality of microfluidic channels may be configured such that the first conduit of each microfluidic channel is connected to a common first reservoir and the second conduit of each microfluidic channel is connected to a common second reservoir. In another embodiment, each individual first and second conduit of a microfluidic channel is connected to a separate first and second reservoir. In some embodiments, for example, the fluid reservoirs can be wells of a 96-well standard microplate. The first conduit can be connected to a first well, and the second conduit can be connected to a second well.

Generally, the spotter orifices will be arranged in a 2-D array. The array can be in a chess board or honeycomb pattern. However, there may be situations where a different orifice pattern such as a random pattern may be desired. Any number of orifice patterns can be built into the spotter face.

The spotter can include any number of orifices. In one variation, there are two wells (or other fluid source/fluid receiving chambers) for each orifice. In such an arrangement, fluid can flow back and forth (or in one direction) between the paired wells. Therefore, a spotter with 1536 wells would typically have 768 orifices. A spotter with 384 wells would have 192 orifices. A spotter with 192 wells would have 96 orifices. A spotter with 96 wells would have 48 orifices. A spotter with 16 wells would have 8 orifices and so on. Any other number of wells and orifices can be used as well. This variation allows a pumping manifold to be placed over half of the wells and substances placed in the other half of the wells. A pump is connected to the pump manifold, and the pump then delivers alternating positive pressure and vacuum pressure. This structure may cycle the substances back and forth between the wells via the micro-conduits.

As used herein, the term "pump" includes devices that can deliver positive pressure, alternating positive pressure and vacuum pressure, or just vacuum pressure. Gravity flow can be used as the pump as well. Similarly, "pumping manifold" refers to any device for interfacing between the spotter wells and the pump, regardless of whether positive pressure or vacuum pressure is being delivered. The pumping manifold may be designed to apply the same pressure to each well or to apply different pressures to each well. In some cases, a single pump and/or valve can be provided for all of the wells. In other cases, unique valves and pumps can be provided for each well.

The contact spotters can operate by flowing a fluid containing the desired substance over the deposition surface, so that the desired substance adheres to the deposition surface, forming a spot. Specifically, the spotter increases the surface density of the desired substance at each spot by directing a flow of the desired substance over the spot area until a high-density spot has been created. The desired substances can in many cases be probe compounds or target compounds. Examples of probes and targets that can be flowed over a surface include: proteins; nucleic acids, including deoxyribonucleic acids (DNA) and ribonucleic acids (RNA); cells; peptides; lectins; modified polysaccharides; synthetic composite macromolecules; functionalized nanostructures; synthetic polymers; modified/blocked nucleotides/nucleosides; synthetic oligonucleotides; modified/blocked amino acids; fluorophores; chromophores; ligands; chelates; haptens; drug compounds; antibodies; sugars; lipids; liposomes; tissue; viruses; any other nano- or microscale objects; and any combinations thereof. As a substance flows over the deposition surface, it can bind or adsorb to the surface, depending on the chemistry involved in the system.

The spotter face can be adapted to form a seal with the deposition surface. Often the surface will be relatively smooth such a microslide or wafer. However, the spotter face and the orifices may be configured to mate with any surface. For example, if a surface has existing wells or canals, the spotter face and orifices can be modified so that the orifices are able to form a seal with the uneven surface. The spotter face refers to the spotter surface that mates with a deposition surface upon which a substance is to be flowed, such as a microarray substrate. In some embodiments, the spotter face may be a flat surface regardless of the number of orifices included within the spotter. Viewing the spotter face in the horizontal plane, when it is desired that the spotter face be a flat surface it is preferable that the orifices deviate from each other less than 1 mm in the vertical plane, even more preferable less than 100 microns, even more preferable less than 50 microns, even more preferable less than 20 microns, and even more preferable less than 5 microns.

However, the spotter face need not be a flat surface. For example, the spotter face can merely be the orifices of the distal ends of a bundle of microtubules. In this embodiment, if the orifices are circular, the spotter face will be a collection of rings. In a bundle of microtubules, gaps, rather than a solid surface, may be present between the outer edges of the orifices. These gaps may also be filled in, if desired, by methods known in the art. For example, in the microtubule embodiment, the microtubules may be held together by an epoxy used to fill in the gaps between the channels. The cured epoxy and channels may then be cut and/or polished to form a smooth surface.

The spotter face can be so configured that when the face is pressed against a substrate surface, a fluid-tight seal should form, so that each cavity becomes a sealed chamber defined by the walls of the cavity and the area of substrate surface onto which the cavity opens. That is, the spotter face can be so configured that pressing it against the substrate is sufficient to create the fluid-tight seal. The seal insures that a fluid moving through the conduit into each cavity/chamber contacts only the area of substrate constituting the floor of the chamber, without escaping to surrounding areas. This also ensures that portions of the surface against which the face is pressed (but are not exposed to a cavity) will receive no contact with the fluid and therefore be substantially free of any binding substance in the fluid.

The spotter face can be any size or geometry. The spotter face may be designed to cover a 76 cm×26 cm microscope slide, or even a 25 mm, 50.8 mm, 76.2 mm, 100 mm, 125 mm, 150 mm, 200 mm, or 300 mm wafer. Additionally, the spotter face can be designed to correspond to any substrate or structure on a substrate. For example, if a substrate has ridges, the spotter face may be modified to have valleys that mate with the substrate ridges or vice versa. The spotter face may also be made rigid or of sufficient flexibility to conform to a substrate surface. In some embodiments, the spotter face is designed so as to facilitate integrating the spotter with an analysis platform. For example, the spotter may be designed so as to seal effectively onto a substrate that can serve as the transducer face of known analysis platforms such as a surface plasmon resonance imaging (SPRi) platform.

In some embodiments, the system can include a biosensor adjacent to the deposition surface configured to detect substances on the deposition surface. In further embodiments, the deposition surface can be a sensing surface of a biosensor. The biosensor can use detection methods based on surface plasmon resonance (SPR), critical angle refractometry, total internal reflection fluorescence (TIRF), total internal reflection phosphorescence, total internal reflection light scattering, evanescent wave elipsometry, Brewster angle reflectometry, quartz crystal microbalance (QCM), and others. In one embodiment, the system is a dual flow cell microfluidic delivery system for a surface plasmon resonance (SPR) imager.

A few examples of surface materials that that can be used for depositing substances with the spotter include: glass, silicon, streptavidin-gold chips, plain gold chips, and dextran-coated gold chips. Any number of surfaces may be used Components of the spotter can be manufactured from any suitable material that is compatible with the substances to be flowed through the spotter, such as silicon, silica, gallium arsenide, glass, ceramics, quartz, neoprene, polytetrafluoroethylene polymers, perfluoroalkoxy polymers, fluorinated ethylene propylene polymers, tetrafluoroethylene copolymers, polyethylene elastomers, polybutadiene/SBR, nitriles, and combinations thereof. In one embodiment, polydimethylsiloxane (PDMS) can be used, and in another embodiment, thermoplastic elastomer can be used. Such materials can allow compression about the orifice to facilitate sealing of the orifice against the deposition surface. In one aspect, the orifice can include an outer rim that protrudes and can be configured to compress and form a seal with the deposition surface.

Multichannel SPR can be used in accordance with examples of the present disclosure. Multiplex and array detection of antigen/antibody interactions in high throughput screening applications, such as drug discovery and proteomics research where many thousands of ligand-receptor or protein-protein interactions, can be among the most desirable for use with the present technology. The simultaneous, real-time measurement of arrays allows for real-time referencing, dosed antigen responses, and buffer/condition optimization. Additionally, dedicated control channels can be used to improve the quality of the binding data.

As mentioned, in some embodiments, the second contact spotter can be a single-orifice large format contact spotter. Again, the term "first" and "second" are relative terms to one another and can be used interchangeably herein. Referring again to FIG. 1, the second contact spotter 108 is a single orifice large format contact spotter with a spotting orifice 110, a flow chamber 116, a second fluid conduit 112 to feed fluid to the flow chamber, and a return conduit 119 to return the fluid to the fluid reservoir 114. The single-orifice large format contact spotter can have a single orifice that is large enough to deposit a substance over the entire area of all the multiple spots deposited by the first contact spotter 102.

Figure 2:
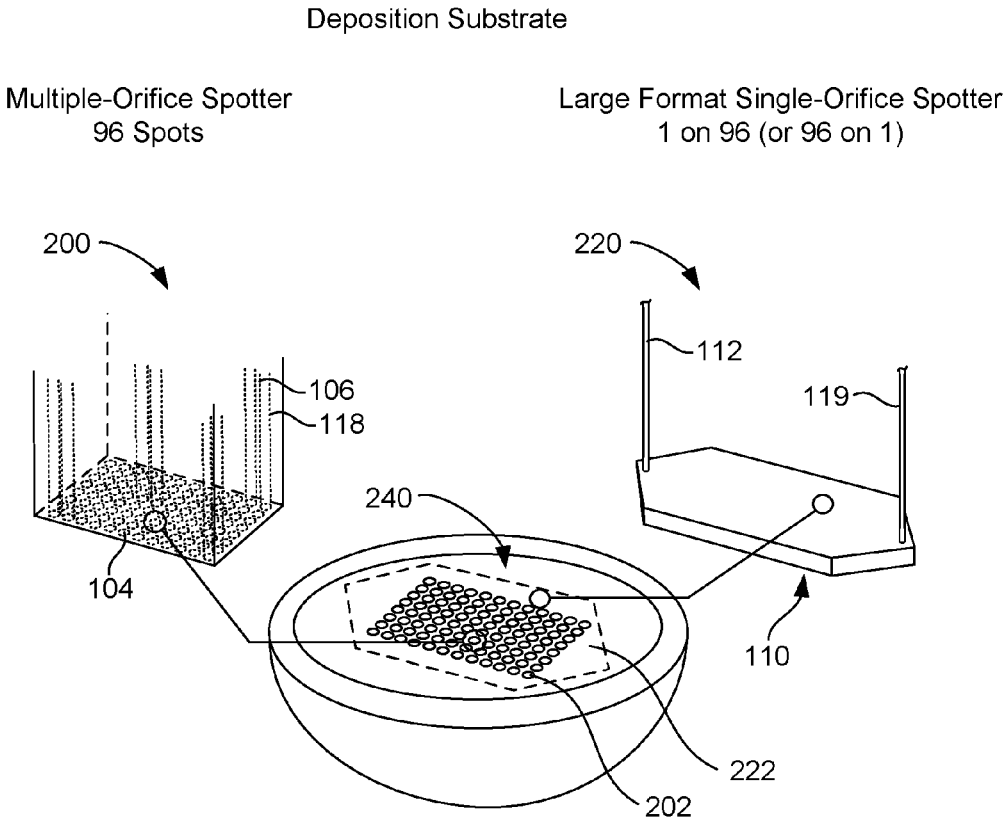
FIG. 2 is an illustration of aspects of a contact spotter with multiple spotting orifices and a large format contact spotter with a single spotting orifice in accordance with an embodiment of the present disclosure.

Another view of a multiple-orifice spotter 200 and a single-orifice spotter 220 is shown in FIG. 2. In the particular embodiment shown, the multiple-orifice spotter can deposit 96 different substance spots 202 from many orifices 104 on an SPR imager or other deposition substrate 240. The single-orifice spotter has an orifice 110 large enough to cover all 96 of the spots with a large single spot 222. This being stated, the reverse order can also be carried out where the large spot is applied first, followed by the multiple smaller spots. Therefore, the single-orifice spotter can be used either to activate the surface before applying the 96 substances, or to flow a target substance over all 96 spots after the multiple-orifice spotter deposits 96 probe compounds onto the surface. It is noted that the 96 orifice spotter shown in FIG. 2 does not show each and every conduit that feeds each and every orifice spotter for clarity purposes. However, it is understood that typically each orifice will typically include multiple microchannels or conduits 106,118, as shown as vertical phantom lines on a few of the orifices, also shown in phantom lines. The microchannels or conduits 112, 119 for the single-orifice spotter are not shown in phantom lines as they are not hidden behind any walls in the present example.

In accordance with this example, various methods of spotting substrates are disclosed herein. In one example, the method can comprise using an automated positioning system to position and seal a first contact spotter to the substrate, the first contact spotter having a plurality of flow chambers in fluid communication with a plurality of spotting orifices; and flowing a plurality of fluids through respective flow chambers to deposit multiple compositionally different first substance spots on the substrate. Additional steps can include using the automated positioning system to remove the first contact spotter and position and seal a second contact spotter to the substrate at a location that overlaps the first substance spots, the second contact spotter having a spotting orifice large enough to cover at least a plurality of the first substance spots; and flowing a second fluid containing a second substance through the second contact spotter to contact the plurality of the first substance spots. In one embodiment, the second spotter in this example can cover all of the spots provided by the first spotter. These types of methods can be referred to as a "one-on-many" approach. Thus, in this situation, for example, the multiple-orifice spotter can be used first to immobilize multiple probe compounds on the deposition surface. Then the single-orifice spotter can flow a single target compound over all the spots of different probe compounds. For example, a 96-orifice spotter can immobilize 96 different antibodies onto the deposition surface. Then the single-orifice spotter can be used to flow a fluid containing a single antigen over all 96 spots.

In another example, a method of spotting a substrate can comprise using an automated positioning system to position and seal a first contact spotter to the substrate, the first contact spotter having at least one flow chamber in fluid communication with a spotting orifice; and flowing a first fluid to deposited a first substance on an area of the substrate. Additional steps can include using the automated positioning system to remove the first contact spotter and position and seal a second contact spotter to the substrate at a location that overlaps the area, wherein the second contact spotter includes a plurality of flow chambers in fluid communication with a plurality of spotting orifices; and flowing a plurality of distinct fluids through respective flow chambers of the second contact spotter to deposit multiple compositionally different second substance spots over the area. In one embodiment, the first spotter in this example can cover a large enough area where all of the smaller spots contact the area. These types of methods can be referred to as a "many-on-one" approach. Thus, in this situation, a single-orifice contact spotter can be used to activate the deposition surface before applying target substances through the multiple-orifice spotter. Activation agents are often expensive. The single orifice contact spotter can reduce costs by activating the deposition surface using only a minimal volume of activation agent.

In further embodiments, a method of spotting a substrate can comprise steps of using an automated positioning system to position and seal a first contact spotter to the substrate, the first contact spotter having a plurality of flow chambers in fluid communication with a plurality of spotting orifices; and flowing a plurality of fluids through respective flow chambers to deposit multiple compositionally different first substance spots on the substrate. Additional steps can include using the automated positioning system to remove the first contact spotter and position and seal a second contact spotter to the substrate at a location that overlaps the first substance spots, the second contact spotter also having a plurality of spotting orifice; and flowing a plurality of fluids through respective flow chambers to deposit multiple compositionally different second substance spots in contact with the plurality of the first substance spots, thereby providing multiple combinations of first and second substance spots. Thus, both the first and second contact spotters can be a large format contact spotter with multiple spotting orifices. For example, each of the large format orifices can be large enough to cover some, but not all, of the spots formed by the first contact spotter. In one example, the first spotter can have 96 orifices, and the second spotter can have 2 flow cells that each cover 48 of the spots. In another example, the second spotter can have 4 flow cells that each cover 24 of the spots, and so on. Furthermore, in some embodiments, the second spotter can have the same number of orifices as the first spotter. The orifices can be substantially the same size and arrangement on the first and second spotter, so that they deposit overlapping spots. This can be useful for many-on-many multiplexing experiments. These are examples of a "many-on-many" or "multiple-on-multiple" approach. It is noted that "many-on-many" can include at least two on at least two in the broadest sense. However, typically, one of the two flow cells will include more than two flow cells, and typically both will include more than two flow cells, e.g., at least 2-on-2, at least 4-on-4, at least 2-on-8, at least 8-on-2, at least 16-on-16, etc. A few specific examples might be 2-on 96, 96-on-2, 4-on-96, 96-on-4, 8-on-96, 96-on-8, and so forth. For example in a many-on-many embodiment, a first contact spotter might comprise an array of spotting orifices from 4 to 1536, e.g., 4, 8, 16, 32, 48, 96, 192, 384, 768, or 1,536, and the second contact spotter might comprise an array of spotting orifices from 2 to 16 (or more), e.g., 2, 4, 8, or 16. Conversely, in a one-on-many or many-on-one example, the first contact spotter may have the same range (4 to 1536), but the second contact spotter will only have one contact spotter (or at least only one contact spotter in use). Again, in this case the multiple contact spotter is referred to as the "first" contact spotter, and the single contact spotter is referred to as the "second" contact spotter, but no order or importance is implied by this relative description, and these terms can be used interchangeably.

The systems described herein can include a positioning device adapted to alternatively position and seal the first contact spotter and second contact spotter on the deposition surface. In some embodiments, the positioning device can be automated. Using such an automated system, researchers can carry out high-throughput experiments with greatly reduced labor time.

The positioning device can include robotically controlled motors and sensors to position and seal the spotters on the deposition surface. For example, the positioning system can include optical sensors, force sensors, and other sensors to monitor the location of the positioning system in 3D space. In one example, one or more force sensors can be associated with the spotters or with the deposition surface to measure the force applied by the spotters to the deposition surface. A specific predetermined magnitude of force can be associated with a sufficiently fluid-tight seal of the spotter against the deposition surface. The positioning system can be configured to lower the spotter onto the deposition surface and stop lowering when the predetermined force is reached. In another example, the positioning system can have a "hard setup," in which the components of the system are assembled with sufficiently tight tolerance that lowering the spotter by a predetermined amount forms a fluid-tight seal without the need of a force sensor.

The positioning system can include one or more motors to position the spotters relative to the deposition surface. In some examples, the positioning system can move the spotters while the deposition surface remains still. In other examples, the positioning system can move the deposition surface while the spotters remain still. In still further examples, the positioning system can move both the spotters and the deposition surface.

The positioning system can include any arrangement of motors or other actuators for alternatively sealing the first and second contact spotters to the deposition surface. For example, the positioning system can include robotic arms that can raise and lower, rotate, swing, or otherwise move the spotters or the deposition surface. In some examples, the first and second contact spotters can be maintained in a common plane throughout the process of positioning and sealing the first and then the second contact spotter to the deposition surface. In one example, the spotters can be movable along a linear track. The first and second spotter can move linearly above the deposition surface and then be lowered onto the deposition surface. Robotically controlled stepper motors can be used to move the spotters predetermined distances. The first and second spotter can both be attached to an assembly, and the assembly can move as a unit in the linear direction along the linear track and vertically to contact the deposition surface. Thus both spotters can be positioned by the positioning system without requiring separate actuators for each spotter.

Figure 3:
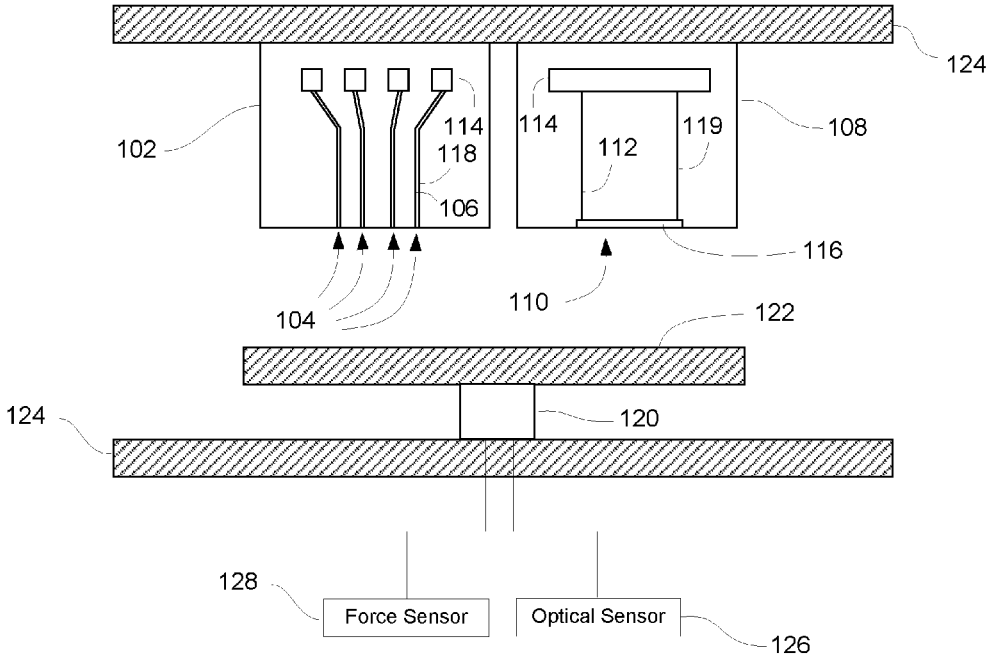
FIG. 3 is an illustration of aspects of a dual contact spotter system in accordance with an embodiment of the present disclosure.

Referring again to FIG. 1, the embodiment shown includes a first contact spotter 102 and a second contact spotter 108 with an actuator 120 for each contact spotter. The actuators can move the spotters along the linear track 124. A force sensor 128 and optical sensor 126 are also associated with each spotter. The optical sensors aid in positioning the spotters over the deposition surface, and the force sensors aid in creating a sufficient seal with the deposition surface. A different embodiment is shown in FIG. 3, in which the first and second contact spotters are fixed and the deposition surface 122 is associated with an actuator. In this embodiment, the deposition surface moves to form a seal with the first and second contact spotters alternatively. A force sensor and optical sensor associated with the deposition surface can aid in positioning and sealing the deposition surface with the contact spotters.

The positioning system can also include any other arrangement of actuators, motors, sensors, and other equipment that is sufficient to alternatively position and seal the contact spotters to the deposition surface. Therefore, the positioning system is not limited to the specific embodiments described above.

The actuators, sensors, and other components of the positioning system can be controlled by a processing unit. The processing unit can be incorporated into the system, such as an integrated computer. Alternatively, the processing unit can be an external unit, such as a personal computer. The positioning system can transmit data to the processing unit and receive instructions from the processing unit through a wired or wireless connection. The processing unit can also control other components of the system, such as pumps for flowing fluid through the contact spotters, devices for refilling fluid reservoirs, devices for changing deposition substrates, biosensors, and so on.

In some embodiments, the deposition surface can be submerged under a liquid to protect proteins or other sensitive substances that would be damaged or destroyed by contact with the air. For example, the spotters can be lowered into a bath of fluid in a reservoir and the spotting orifices can be compressed against the deposition surface to form a seal. The orifices can function as gaskets to form a reversible seal by the application of a force. If any fluid in the reservoir enters the spotter through the orifice, the fluid can be cycled through one of the conduits as printing begins. Printing onto a submerged surface can prevent exposure of the deposition spot to air after printing and the spotter is removed. Alternatively, particularly with microfluidics and very small orifices, when the orifice is passed through the liquid in the reservoir and onto the deposition surface, often the liquid in the reservoir may not enter through the orifice due to surface tensions of the respective fluids. In still other examples, fluid can be added to the reservoir after the orifice has formed a seal with the deposition surface and prior to removal of the spotter from the deposition surface. This can ensure that the deposition spot will be covered by fluid upon removal of the spotter from the deposition surface.

Figure 4:
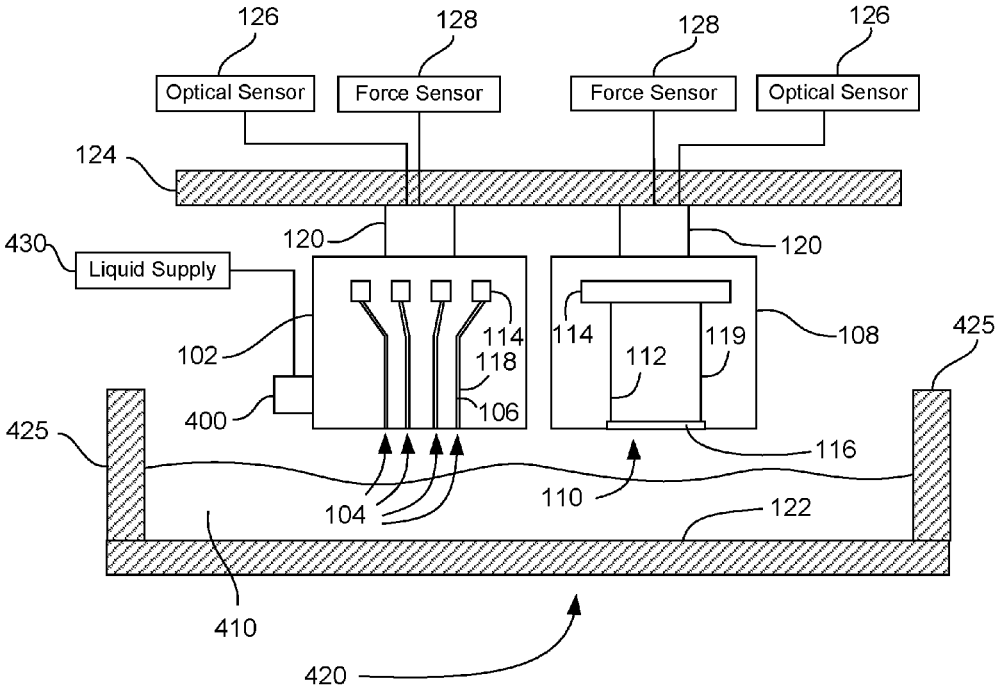
FIG. 4 is an illustration of aspects of a dual contact spotter system in accordance with an embodiment of the present disclosure.

As illustrated in FIG. 4, a liquid delivery feature 400, such as a dispensing needle, can supply liquid 410 and facilitate submersion of the deposition surface 122. The liquid delivery feature can be in any suitable location and can be configured to supply a liquid 410 to a reservoir 420. The liquid can be retained in the reservoir by reservoir side walls 425. A liquid supply 430 can be fluidly connected to the liquid delivery feature. In one aspect, a liquid sensor can be included and used to cease the supply of liquid at a predetermined level to ensure that an adequate amount of liquid has been delivered to the reservoir. In another aspect, the liquid delivery feature can deliver a predetermined amount of fluid to the reservoir. For example, the liquid delivery feature can be adapted for metered filling of the reservoir before or after printing. In a specific aspect, delivery of fluid to the reservoir can be controlled by a processing unit. Automated delivery of fluid to the reservoir can therefore ensure that the deposition spot stays hydrated when the seal is broken between the orifice and the deposition surface as the spotter is removed from the deposition surface, which can enable an automated printing process for biological membranes and associated proteins.

In the embodiment of FIG. 4, the deposition surface 122 is the bottom surface of the liquid reservoir 420. In other embodiments, the deposition surface can be separate from the liquid reservoir, but positioned in the liquid reservoir so that the deposition surface is submerged in the liquid after filling the reservoir. In some cases, the liquid can be a solution, such as a buffered salt solution for maintaining biomaterials at a physiological pH and osmotic pressure.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements can be devised without departing from the spirit and scope of the described technology. Furthermore, both systems and methods are described herein. Any discussions or descriptions related to the system is relevant and fully supports discussions and descriptions of the method, and vice versa, regardless of the context.

What is claimed is:

1. A system for depositing substances onto a deposition surface, comprising:

a first contact spotter comprising multiple spotting orifices fed by multiple fluid inlet conduits such that the first contact spotter is capable of depositing multiple spots of different substances onto the deposition surface simultaneously;

a second contact spotter comprising a second spotting orifice fed by a second fluid inlet conduit; and a positioning device adapted to alternatively position and seal the first contact spotter and second contact spotter on the deposition surface at an overlapping location, wherein each contact spotter is a continuous flow microspotter, comprising:

an outlet cavity defined at least in part by a spotting orifice, a first opening, and a second opening;

a first conduit fluidly coupled to the first opening; and a second conduit fluidly coupled to the second opening, wherein each continuous flow microspotter is adapted so that fluid flowing through the first conduit and the second conduit is communicated among the first opening, the second opening, and a deposition surface when the spotting orifice is sealed against the deposition surface to form a deposition spot on the deposition surface.

2. The system of claim 1, wherein the first contact spotter comprises an array of spotting orifices, the number of spotting orifices in the array being 4, 8, 16, 32, 48, 96, 192, 384, 768, or 1,536.

3. The system of claim 1, wherein the second contact spotter is a single-orifice large format contact spotter comprising a single spotting orifice that is large enough to deposit a substance over the entire area of all the multiple spots deposited by the first contact spotter.

4. The system of claim 1, wherein the second contact spotter comprises multiple spotting orifices so that the second contact spotter is capable of depositing multiple spots of different substances onto the deposition surface simultaneously.

5. The system of claim 4, wherein the multiple spotting orifices of the second contact spotter have from 2 to 16 spotting orifices.

6. The system of claim 1, wherein the positioning device is automated.

7. The system of claim 1, wherein the positioning device is configured to position the first contact spotter and second contact spotter by moving one or both of the first contact spotter or the second contact spotter.

8. The system of claim 1, wherein the positioning device is configured to position one or both the first contact spotter or second contact spotter by moving the deposition surface.

9. The system of claim 1, wherein the positioning device is configured to move the first contact spotter and second contact spotter relative to the deposition surface along a linear path.

10. The system of claim 1, wherein the spotting orifices of the first contact spotter and second contact spotter are maintained in a common plane.

11. The system of claim 1, further comprising a force sensor to facilitate sealing of the one or both of the spotting orifices against the deposition surface.

12. The system of claim 1, further comprising an optical sensor to facilitate positioning of one or both of the contact spotters.

13. The system of claim 1, further comprising a liquid reservoir wherein the deposition surface is positioned in the liquid reservoir so that the deposition surface can be submerged in a liquid.

14. The system of claim 13, wherein the deposition surface forms at least a portion of the liquid reservoir.

15. The system of claim 13, further comprising a liquid delivery feature to supply liquid to the liquid reservoir and facilitate submersion of the deposition surface.

16. The system of claim 13, wherein the liquid reservoir comprises the liquid.

17. The system of claim 1, further comprising a biosensor adjacent to the deposition surface configured to detect substances on the deposition surface.

18. The system of claim 1, wherein the deposition surface is a sensing surface of a biosensor.

19. The system of claim 1, wherein the overlapping location is such that the second spotting orifice completely overlaps all of the multiple spots deposited by the multiple spotting orifices.

20. The system of claim 1, adapted such that the first contact spotter deposits multiple spots on the deposition surface prior to the second contact spotter depositing a substance on the deposition surface.

21. The system of claim 1, adapted such that the first contact spotter deposits multiple spots on the deposition surface after the second contact spotter deposits substance on the deposition surface.

22. A method of spotting a substrate, comprising:

using an automated positioning system to position and seal a first contact spotter to the substrate, the first contact spotter having a plurality of flow chambers in fluid communication with a plurality of spotting orifices;

flowing a plurality of fluids through respective flow chambers to deposit multiple compositionally different spots on the substrate;

using the automated positioning system to remove the first contact spotter and position and seal a second contact spotter to the substrate at a location that overlaps the spots, the second contact spotter having a spotting orifice large enough to cover at least a plurality of the spots; and flowing a second fluid containing a second substance through the second contact spotter to contact the plurality of the spots.

23. A method of spotting a substrate, comprising:

using an automated positioning system to position and seal a first contact spotter to the substrate, the first contact spotter having at least one flow chamber in fluid communication with a spotting orifice;

flowing a first fluid to deposited a substance on an area of the substrate;

using the automated positioning system to remove the first contact spotter and position and seal a second contact spotter to the substrate at a location that overlaps the area, wherein the second contact spotter includes a plurality of flow chambers in fluid communication with a plurality of spotting orifices; and flowing a plurality of distinct fluids through respective flow chambers of the second contact spotter to deposit multiple compositionally different substance spots over the area, wherein each contact spotter is a continuous flow microspotter, comprising:

an outlet cavity defined at least in part by the spotting orifice, a first opening, and a second opening;

a first conduit fluidly coupled to the first opening; and a second conduit fluidly coupled to the second opening, wherein each continuous flow microspotter is adapted so that fluid flowing through the first conduit and the second conduit is communicated among the first opening, the second opening, and the substrate when the spotting orifice is sealed against the substrate to form a deposition spot on the substrate.

24. A method of spotting a substrate, comprising:

using an automated positioning system to position and seal a first contact spotter to the substrate, the first contact spotter having a plurality of flow chambers in fluid communication with a plurality of spotting orifices;

flowing a plurality of fluids through respective flow chambers to deposit multiple compositionally different first spots on the substrate;

using the automated positioning system to remove the first contact spotter and position and seal a second contact spotter to the substrate at a location that overlaps the spots, the second contact spotter also having a plurality of spotting orifices; and flowing a plurality of fluids through respective flow chambers to deposit multiple compositionally different second spots in contact with the plurality of the spots, thereby providing multiple combinations of first and second spots, wherein each contact spotter is a continuous flow microspotter, comprising:

an outlet cavity defined at least in part by the spotting orifice, a first opening, and a second opening;

a first conduit fluidly coupled to the first opening; and a second conduit fluidly coupled to the second opening, wherein each continuous flow microspotter is adapted so that fluid flowing through the first conduit and the second conduit is communicated among the first opening, the second opening, and the substrate when the spotting orifice is sealed against the substrate to form a deposition spot on the substrate.

25. A system for depositing substances onto a deposition surface, comprising:

a first contact spotter comprising multiple spotting orifices fed by multiple fluid inlet conduits such that the first contact spotter is capable of depositing multiple spots of different substances onto the deposition surface simultaneously;

a second contact spotter comprising a second spotting orifice fed by a second fluid inlet conduit; and a positioning device adapted to alternatively position and seal the first contact spotter and second contact spotter on the deposition surface at an overlapping location, wherein the second contact spotter includes a large format contact spotter comprising a single spotting orifice that is large enough to deposit a substance over all of the multiple spots deposited by the first contact spotter.

26. The system of claim 25, wherein the positioning device is automated.

27. The system of claim 25, wherein the positioning device is configured to position the first contact spotter and second contact spotter by moving one or both of the first contact spotter or the second contact spotter.

28. The system of claim 25, wherein the positioning device is configured to position one or both the first contact spotter or second contact spotter by moving the deposition surface.

29. The system of claim 25, wherein the positioning device is configured to move the first contact spotter and second contact spotter relative to the deposition surface along a linear path.

30. The system of claim 25, wherein the spotting orifices of the first contact spotter and second contact spotter are maintained in a common plane.

31. The system of claim 25, further comprising a force sensor to facilitate sealing of the one or both of the spotting orifices against the deposition surface.

32. The system of claim 25, further comprising an optical sensor to facilitate positioning of one or both of the contact spotters.

33. The system of claim 25, further comprising a liquid reservoir wherein the deposition surface is positioned in the liquid reservoir so that the deposition surface can be submerged in a liquid.

34. The system of claim 33, wherein the deposition surface forms at least a portion of the liquid reservoir.

35. The system of claim 33, wherein the liquid reservoir comprises the liquid.

36. The system of claim 33, further comprising a liquid delivery feature to supply liquid to the liquid reservoir and facilitate submersion of the deposition surface.

37. The system of claim 25, further comprising a biosensor adjacent to the deposition surface configured to detect substances on the deposition surface.

38. The system of claim 25, wherein the deposition surface is a sensing surface of a biosensor.

39. The system of claim 25, adapted such that the first contact spotter deposits multiple spots on the deposition surface prior to the second contact spotter depositing a substance on the deposition surface.

40. The system of claim 25, adapted such that the first contact spotter deposits multiple spots on the deposition surface after the second contact spotter deposits substance on the deposition surface.

41. The system of claim 25, wherein the first contact spotter comprises an array of spotting orifices, the number of spotting orifices in the array being 4, 8, 16, 32, 48, 96, 192, 384, 768, or 1,536.

* * * * *